US012788052B2

(12) United States Patent
Wright et al.

(10) Patent No.: US 12,788,052 B2
(45) Date of Patent: Nov. 10, 2026

(54) AEROSOL GENERATING ARTICLE WITH A WRAPPER COMPRISING A TOBACCO LEAF PORTION

(71) Applicant: JT International SA, Geneva (CH)

(72) Inventors: Alec Wright, Guildford (GB); Andrew Robert John Rogan, Forres Moray (GB)

(73) Assignee: JT International SA, Geneva (CH)

( * ) Notice: Subject to any disclaimer, the term of this patent is extended or adjusted under 35 U.S.C. 154(b) by 405 days.

(21) Appl. No.: 18/293,664

(22) PCT Filed: Jul. 29, 2022

(86) PCT No.: PCT/EP2022/071398
§ 371 (c)(1),
(2) Date: Jan. 30, 2024

(87) PCT Pub. No.: WO2023/006968
PCT Pub. Date: Feb. 2, 2023

(65) Prior Publication Data

US 2024/0341347 A1 Oct. 17, 2024

(30) Foreign Application Priority Data

Jul. 30, 2021 (EP) ..... 21188811

(51) Int. Cl.
*A24C 5/01* (2020.01)
*A24B 15/12* (2006.01)
(Continued)

(52) U.S. Cl.
CPC ..... *A24D 1/025* (2013.01); *A24B 15/12* (2013.01); *A24C 5/01* (2020.01); *A24D 1/002* (2013.01); *A24D 1/20* (2020.01)

(58) Field of Classification Search
CPC ..... A24D 1/025; A24D 1/20
See application file for complete search history.

(56) References Cited

U.S. PATENT DOCUMENTS

2013/0206152 A1* 8/2013 Urbano et al. ..... A24D 1/045
2019/0045837 A1* 2/2019 Spencer ..... A24D 1/002
(Continued)

FOREIGN PATENT DOCUMENTS

CN 102227174 A 10/2011
CN 106379645 A 2/2017
(Continued)

OTHER PUBLICATIONS

International Search Report for PCT/EP2022/071398 mailed Nov. 3, 2022. 3 pages.

*Primary Examiner* — Christopher M Rodd
*Assistant Examiner* — Ronnie Kirby Jordan
(74) *Attorney, Agent, or Firm* — Lerner David LLP

(57) ABSTRACT

An aerosol generating article, for use in a non-combustible aerosol generating device including a filtering mouthpiece, an aerosol generating segment and a spacer element positioned between the aerosol generating segment and the filtering mouthpiece, is wrapped at least partially by a first wrapper, wherein the first wrapper includes an outer and an inner surface. Furthermore, the aerosol generating article extends in a length and a circumferential direction. The first wrapper includes at least one tobacco leaf portion. A method for manufacturing such an aerosol generating article is also provided.

21 Claims, 4 Drawing Sheets

(51) Int. Cl.

| | |
|---|---|
| ***A24D 1/00*** | (2020.01) |
| ***A24D 1/02*** | (2006.01) |
| ***A24D 1/20*** | (2020.01) |

(56) References Cited

U.S. PATENT DOCUMENTS

| | | | | |
|---|---|---|---|---|
| 2019/0269169 | A1* | 9/2019 | Malgat ..... | A24D 1/02 |
| 2021/0092991 | A1 | 4/2021 | Brookbank et al. | |

FOREIGN PATENT DOCUMENTS

| | | | |
|---|---|---|---|
| CN | 111918563 | A | 11/2020 |
| EP | 3503747 | B1 | 12/2020 |
| EP | 3 779042 | A1 | 2/2021 |
| JP | 2016195585 | A | 11/2016 |
| JP | 2019526251 | A | 9/2019 |
| WO | 2010051076 | A1 | 5/2010 |

* cited by examiner

AEROSOL GENERATING ARTICLE WITH A WRAPPER COMPRISING A TOBACCO LEAF PORTION

CROSS-REFERENCE TO RELATED APPLICATIONS

The present application is a national phase entry under 35 U.S.C. § 371 of International Application No. PCT/EP2022/071398, filed Jul. 29, 2022, published in English, which claims priority to European Application No. 21188811.0 filed Jul. 30, 2021, the disclosures of which are incorporated herein by reference.

FIELD OF THE INVENTION

The present invention relates to an aerosol generating article with a wrapper comprising a tobacco leaf portion for use in a non-combustible aerosol generating device. The invention also relates to a method for manufacturing such as an aerosol generating article.

BACKGROUND

The customers who use the Heat-not-Burn vapor devices are often accustomed to a certain type of sticks. Such sticks can be used in vapor devices with both outside and inside heating systems and due to this they are often wrapped in a paper wrapper without aluminium foil paper. The use of aluminium foil paper makes recycling of the Heat-not-Burn sticks difficult. However, the sticks without aluminium foil can give an unpleasant paper taste to the user during the smoking session in the devices with the outside heating system. EP3503747B1 describes an aerosol generating article comprising an aerosol-forming material and a tobacco containing wrapper around and in contact with the aerosol-generating material. The tobacco containing wrapper improves the initial odour of aerosol-generating article. However, during use in the devices with the inside heating system, such sticks may obtain humectant stains on the outer wrapping which may significantly reduce a stability of the stick construction.

SUMMARY

It is therefore the objective of the invention to improve the properties of an aerosol generating smoking article according to a taste, an esthetic appearance and its recyclability. Preferably such aerosol generating articles are useable in all common non-combustible aerosol generating devices. Furthermore, the objective of the invention is also to provide a method of manufacturing the mentioned aerosol generating articles.

The above-mentioned requirement is met by the object of claim 1. Preferred embodiments are objects of the dependent claims.

An aerosol generating article for use in a non-combustible aerosol generating device comprises a filtering mouthpiece, an aerosol generating segment and a spacer element. Furthermore, the aerosol generating article extends in a length and a circumferential directions. The spacer element may additionally act as a cooling element that the effectively reduces the temperature of a generated aerosol before it reaches the filtering mouthpiece. The spacer element is positioned between the aerosol generating segment and the filtering mouthpiece. The spacer element preferably comprises a tubular element such as a hollow or filled paper or polymer tube. The filling material in the tube may be for example PLA wrap and the like. The article may further comprise a support element between the cooling element and the aerosol generating segment. The support element is configured to support and maintain the aerosol substance in place in the segment. Furthermore, the support element may be formed of a thicker, more rigid and/or shorter tubular element than the spacer element. The support element is optional and may be replaced by a longer spacer element of sufficient rigidity and proper thickness. The aerosol generating article is wrapped at least partially by a first wrapper. According to the invention, the first wrapper comprises an outer and an inner surface. Moreover, the first wrapper comprises at least one tobacco leaf portion. The tobacco leaf portion is a part of a pre-shaped, harvested and aged tobacco plant leaf.

The tobacco leaf portion is preferably a part of a common tobacco plant leaf. Such tobacco plant leaves are known from smoking products like cigars or cigarillos. Preferably the tobacco leaves are harvested and aged by curing process. Preferably the tobacco leaf portion comprised in the aerosol generating article is pre-shaped to an elongated piece. Preferably the elongated piece for use as the tobacco leaf portion and the first wrapper comprises the same or at least similar dimensions at least in a wrapped state of the aerosol generating article. The tobacco leaf portion preferably comprises nicotine and/or other volatile organic compounds. Due to this, it is possible that the aerosol generated article surrounded by the first wrapper comprising tobacco leaf portion may comprise an increased content of nicotine and/or other volatile organic compounds compared to usual aerosol generating articles where the wrapper comprises paper or cellulose based material and/or metal.

Preferably the aerosol generating segment, the spacer element and the filtering mouthpiece extend along the length direction of the article. Also preferably the aerosol generating segment form a distal end of the article and the filtering mouthpiece forms a proximal end of the aerosol generating article. The aerosol generating segment, the spacer element and the filtering mouthpiece and optionally other elements (e.g. support element) preferably comprise a rod or tubular shape being preferably fully surrounded by the first wrapper.

However, the tobacco leaf portion comprised in or on the first wrapper of the aerosol generating article is preferably usable in the aerosol generating devices with the outer and/or the inner heating system as described above. Ideally, the aerosol generating article with the tobacco leaf portion used in the device with an outside heating system develops an enhanced tobacco taste instead of the unpleasant paper taste. The tobacco leaf portion when heated influences the characteristics of the generated aerosol or vapor. It has been found that the wrapper in general might influence in particular the composition and/or taste of the vapor of the aerosol generating article. Thus, the effects depend on the material used as the first wrapper or on the wrapper (e.g. coating). The tobacco leaf portion forming as or on the first wrapper of the aerosol generating article might impart constituents to the vapor. The interaction of generated aerosol or vapor with the tobacco leaf portion of the aerosol generating article increases the true tobacco taste.

Furthermore, the aerosol generating article with the tobacco leaf portion reduces the stains of the wrapper by moisturizer, liquid solvent or humectants migrating from the aerosol generating segment, such as glycerol or propylene glycol. The tobacco leaf portion either attached to the first wrapper or constituted thereby, contribute to maintain the physical and chemical stability of the aerosol generating article, in particular even if the stability is affected by condensed liquid. The tobacco leaf portion may on the one hand increase the mechanical properties, in particular the rigidity and tear resistance of the aerosol generating article compared to the conventional HnB sticks. On the other hand, the tobacco leaf portion may additionally support a construction of the aerosol generating article thereby increasing a stability of the article. For this task, the tobacco leaf portion may be attached to a most stressed part of the construction to act as a supporting Furthermore, the tobacco leaf portion attached at least at the distal end of the aerosol generating article may prevent or mask unwanted discoloration (e.g. browning) after heating with the heating system, in particular with the outer heating system. Moreover, as the tobacco leaf portion is positioned at least at the distal end of the aerosol generating article, it can provide a more intense taste of tobacco during the vaping session.

Preferably the aerosol generating segment comprises a tobacco product or substrate comprising any one or any combination of: tobacco leaf, tobacco pulp, tobacco extract, tobacco oil, cured tobacco, finely cut tobacco leaves and homogenized tobacco. Preferably, reconstituted tobacco may comprise tobacco cast sheet, reconstituted tobacco paper, reconstituted tobacco laminate, reconstituted tobacco extrudate and combinations thereof. The tobacco substrate may further comprise cellulose pulp, fibers or fillers. The volatile composition and the intensity of the tobacco aroma in the generated aerosol may be adjusted by the type of tobacco product or substance, the tobacco grades, origins and blends, etc. For example, smaller tobacco particles may provide a more intense tobacco taste and release higher volatiles content compared to the bigger tobacco particles of a same grade due to the larger surface contact of the smaller particles with entraining air.

It is conceivable that the first wrapper extends circumferentially and/or longitudinally along the aerosol generating article only partially. Preferably the filtering mouthpiece and/or the aerosol generating segment comprise parts which are not covered by the first wrapper. Thus, the length of the first wrapper may be shorter than a total length of the aerosol generating article measured along the longitudinal direction. Since tobacco leaves are relatively expensive, it is conceivable that the tobacco leaf portion comprises a smaller dimension than the circumferential and/or longitudinal dimension of the first wrapper. Applying a smaller tobacco leaf portion as an outer surface of the aerosol generating article might reduce the production costs because the small leftover pieces of the tobacco leaves, for example from the cigar production, might be used. The tobacco leaf portion may be formed of one piece or several discrete pieces or be assembled into one single sheet. For example, the piece(s) or sheet may be rolled into a spirally wound leaf portion.

According to another embodiment the tobacco leaf portion extends along the length direction and comprises a length which corresponds to a length of the aerosol generating article. The aerosol generating articles fully circumferentially and longitudinally wrapped with at least one tobacco leaf portion while maintaining air inlet end and aerosol outlet end unwrapped are advantageous because the difficult preparatory processes like wrapping and/or gluing are avoided.

It is conceivable that at least one tobacco leaf portion is provided as a first wrapper of the aerosol generating article. Preferably the tobacco leaf portion circumferentially wraps the aerosol generating segment, the spacer element and/or the filtering mouthpiece.

To improve the recycling of the entire tobacco leaf, it is also conceivable to provide more than one, preferably two, also preferably three or more, tobacco leaf portions being in an elongated shape. Preferably the tobacco leaf portions are adhesively attached to the first wrapper. Several tobacco leaf portions might be distributed on the entire outer and/or inner surface of the first wrapper. In this case the first wrapper is a mechanical supporting element and carries the tobacco leaf portions on the outer and/or inner surface. It is also conceivable that the distributed tobacco leaf portions create a pattern. This allows a recognition value for the aerosol generating articles to be achieved without requirement for coloring or marking the first wrapper.

In another embodiment, the first wrapper is formed of tobacco leaf portions and non-tobacco leaf portions alternately distributed as stripes. Preferably the tobacco leaf stripes and the nontobacco leaf stripes extend along the length direction of the aerosol generating device. This allows to have tobacco leaf stripe in preferred areas, e.g. in areas subject to potential discoloration or staining without requiring the use of dyes, inks or colorants. Furthermore, the tobacco leaf stripe arranged in preferred areas of the article, e.g. in areas subject to humidification through condensation, may improve the stability.

According to another embodiment the tobacco leaf portion extends along the circumferential direction and comprises a circumference which corresponds to a circumference of the aerosol generating article.

It is conceivable that the tobacco leaf portions are attached to the inner and/or outer surface of the first wrapper, preferably as rings. Also preferably, the tobacco leaf rings enclose the aerosol generating article circumferentially.

It is also conceivable that only one ring from the tobacco leaf portion is attached to the inner and/or outer surface of the first wrapper. In this case, the ring is preferably arranged at the distal end of the aerosol generating article. In particular, the ring of the tobacco leaf portion preferably surrounds the aerosol generating segment of the aerosol generating article.

The ring of tobacco leaf portion may replace at least one lacking portion of the first wrapper. The lacking portion of the first wrapper preferably comprises smaller dimensions in comparison to the dimensions of the ring from the tobacco leaf portion. In this case, the tobacco leaf portion comprises at least one adhesive surface which may be glued to portions or edges of the first wrapper thereby replacing the lacking portions with the tobacco leaf portion. Preferably the adhesive surface comprises at least a length in range of 2 mm and 7 mm measured along the length direction of the article.

According to another embodiment the tobacco leaf portion is arranged as the outer and/or inner surface of at least first wrapper.

It is conceivable that the tobacco leaf portion is at least a part of the first wrapper. In this case an outer and inner surface of the tobacco leaf portion is preferably a part of the outer and the inner surface of the first wrapper. For example, the first wrapper of the aerosol generating article may comprise at least one cutout in which the tobacco leaf portion is attached. Alternatively, the first wrapper might comprise at least two parts which are arrangeable sidewise of the tobacco leaf portion. In this case, the tobacco leaf portion preferably surrounds at least the spacer element and each of the first wrapper parts preferably surround the filtering mouthpiece and the aerosol generating segment.

It is also conceivable that the tobacco leaf portion is attached on the outer and/or inner surface of the first wrapper thereby creating a second wrapper of the aerosol generating article. Preferably the tobacco leaf portion as the second wrapper comprises the similar dimensions to the first wrapper. Alternatively, the tobacco leaf portion as the second wrapper comprises smaller or larger dimensions than the first wrapper of the aerosol generating article. The first wrapper may for instance be made of paper or cellulose-based material.

The tobacco leaf portion is preferably a layer of the first wrapper adhesively attached on the outer or inner surface of a second layer of the first wrapper. Thus, the first wrapper may comprise two layers. The layers may be superimposed or at least overlapping. Preferably the second layer of the first wrapper comprises paper or other suitable materials and the first layer comprises the tobacco leaf portion. The tobacco leaf portion may thus protect the second layer of the first wrapper from the damage caused by external aggressive conditions or humectant stains.

Alternatively, at least two tobacco leaf portions are preferably attached on the outer and the inner surface of an internal or core layer of the first wrapper. In this case the first wrapper may comprise a layered structure comprising at least three layers. Preferably the core layer of the first wrapper comprises paper or other suitable fibrous materials. At least one tobacco leaf portion forms the outer layer of the first wrapper and at least one further tobacco leaf portion forms the inner layer of the first wrapper. This makes it possible to produce a particularly stable tobacco and paper mixed construction for an aerosol generating article that does not lose its mechanical stability, especially when it comes into contact with condensed liquid.

According to another embodiment the tobacco leaf portion is formed as a spirally wound tube as the outer and/or inner surface of the first wrapper.

Such aerosol generating article for use in a non-combustible aerosol generating device may also comprise the filtering mouthpiece, the aerosol generating segment and the spacer element. Thus, the aerosol generating article may also extend in a length and a circumferential direction. The spacer element may additionally act as a cooling element that the effectively reduces the temperature of a generated aerosol before it reaches the filtering mouthpiece. The spacer element is positioned between the aerosol generating segment and the filtering mouthpiece. Such aerosol generating article is wrapped at least partially by a first wrapper. The first wrapper comprises an outer and an inner surface and the first wrapper comprises at least one tobacco leaf portion, wherein the said tobacco leaf portion is formed as a spirally wound tube as the outer and/or inner surface of the first wrapper.

Preferably the spirally wounded tobacco leaf portion is fixed into a tube with a suitable adhesive. The adhesive might be a cellulose based glue or other adhesives approved in the smoking article industry. A surface of the tobacco leaf portion may be coated with adhesive for adhering to the outer or inner surface of the first wrapper. The first wrapper preferably surrounds at least one or several parts of the aerosol generating article, preferably such as the filtering mouthpiece, the spacer element and/or the aerosol generating segment. It is also conceivable that the tobacco leaf portion is attached with adhesive at the distal and/or the mouth end of the aerosol generating article. Alternatively or additionally, the edges of the wounded tobacco leaf portion are attached one another by adhesive. Preferably overlapping areas or edges of the spirally wound tube of the tobacco leaf portion are attached by adhesive.

Preferably the first wrapper comprises a layer spirally enveloped with the tobacco leaf portion. Also preferably, the first wrapper comprising the spirally wound tobacco leaf portion forms an additional wrapper of a prewrapped rod of the aerosol generating article.

The spirally wounded tube shaped from the tobacco leaf portion may comprise apertures (windows, cutouts, etc.) through which an underneath portion of the first wrapper is preferably visible from the outside. The apertures may be distributed along the whole length of the aerosol generating article. The apertures of the spirally wounded tube from the tobacco leaf portion may, for instance, comprise a distance to each other in range of 3 mm and 8 mm.

It is also conceivable that the spirally wounded tube shaped from the tobacco leaf portion comprises overlapping leaf areas. The overlapping leaf areas may form adhesively attached areas. They may be spirally wound. Thus, it is conceivable that the overlapping areas are coated with suitable adhesive. Preferably the overlapping areas may be distant along the length of the aerosol generating article at evenly spaced intervals. The overlapping areas may comprise a length in range of 1 mm and 5 mm measured along the length direction. The intervals between the overlapping areas comprise preferably a length of 5 mm and 15 mm measured along the length direction.

It is conceivable to use more than one tobacco leaf portion for wounding around the aerosol generating article. Thus, two or more tobacco leaf portions are formed as the spirally wounded tubes as the outer and/or inner surfaces of the first wrapper.

According to an embodiment the aerosol generating segment is formed as a rod comprising reconstituted tobacco substrate. The reconstituted tobacco preferably comprises tobacco material obtained by collecting the tobacco leaf residues and stems of the tobacco plant. Additionally, the reconstituted tobacco may comprise aerosol formers, binder and/or flavorings.

The reconstituted tobacco substrate may comprise an aerosol-former. Examples of aerosol-formers include polyhydric alcohols and mixtures thereof such as glycerine or propylene glycol. Typically, the aerosol generating substrate may comprise an aerosol-former content of between approximately 5% and approximately 50% on a dry weight basis. In some embodiments, the aerosol generating substrate may comprise an aerosol-former content of between approximately 10% and approximately 20% on a dry weight basis, and possibly approximately 15% on a dry weight basis.

The reconstituted tobacco may be at least one gathered sheet. Preferably the reconstituted tobacco is provided as a sheet being formed in an external forming process. Also preferably, the reconstituted tobacco sheet is folded according to a predefined pattern. Thus, the reconstituted tobacco sheet may be folded in a concertina manner. This would allow a generated stream of vapor in the heated aerosol generated segment to be directed unobstructed through prefolded paths into the spacer element of the aerosol generating article. It is also conceivable that the reconstituted tobacco sheet is randomly gathered being folded without a predefined scheme. The sheet may also be crimped before being gathered.

According to another embodiment the reconstituted tobacco is formed as a plurality of reconstituted tobacco strips or strands extending along the length direction.

The strips or strands may be parts of a reconstituted tobacco sheet being cut to a desired size. Preferably the strips or strands comprise a length similar to a length of the aerosol generating segment measured along the length direction. Also preferably the strips or strands comprise a wide in range of 0.5 mm and 2 mm, preferably 0.3 mm and 1.8 mm, also preferably 2 mm and 5 mm, measured along a direction which is perpendicular to the length direction.

Preferably the reconstituted tobacco is formed as a bundle of reconstituted tobacco strips or strands extending along the length direction of the aerosol generating article. Preferably the plurality or bundle of reconstituted tobacco consists of at least 30 strips, preferably 50 strips, also preferably more than 70 strips. It is also conceivable that the plurality or bundle of reconstituted tobacco comprises at least 15 strands, preferably more than 25 strands, also preferably more than 45 strands.

According to another embodiment the reconstituted tobacco is formed as a reconstituted tobacco cut filler which is preferably randomly oriented in the aerosol generating segment. Preferably the reconstituted tobacco cut filler comprises tobacco particles. Also preferably the tobacco particles comprise a mean particle size (D50) of at least 20 μm. It is also conceivable the reconstituted tobacco cut filler comprises a filler material as a carrier for the tobacco particles. Preferably the carrier comprises parts of the tobacco plant such as stems and leaves.

According to an embodiment the aerosol generating segment is individually wrapped with a second wrapper preferably comprising any one of: paper, cellulose acetate, aluminium foil, tobacco leaf, tobacco paper. It is conceivable that the first and/or the second wrapper comprise a coating which releases constituents interacts in the aerosol (e.g. flavours), has a flame retardant properties and/or enhance moisture resistance.

It is conceivable that the second wrapper comprises standard wrapping paper for aerosol generating articles. Thus, the aerosol generating segment is preferably additionally wrapped with paper. Additionally or alternatively, the aerosol generating segment is surrounded by the first wrapper with at least one tobacco leaf portion and the second wrapper being wrapping paper.

Alternatively, the second wrapper comprises a tobacco leaf at least partially. The aerosol generating segment is preferably wrapped with a first wrapper with at least one tobacco leaf portion and the second wrapper being an additional tobacco leaf portion. It is also conceivable that the first wrapper does not comprise tobacco leaf portion. The second wrapper comprises the tobacco leaf portion instead. Due to this, it is possible that the aerosol generating segment is surrounded by the first wrapper being a paper wrapper and the second wrapper comprising at least one tobacco leaf portion.

In another preferred embodiment the aerosol generating segment is additionally wrapped with a tobacco paper. Preferably, the second wrapper comprises tobacco paper. Thus the aerosol generating segment is preferably surrounded by the first wrapper comprising at least one tobacco leaf portion and the second wrapper being tobacco paper.

Due to the different material properties of the common wrapping paper, the tobacco paper and the tobacco leaves, the desired absorption of the generated vapor in the heated aerosol generating segment might be adjusted through the combination of the materials to each other.

According to another embodiment the aerosol generating article comprises a third wrapper which is adhesively attached to the first wrapper at least partially. Preferably the third wrapper comprises common wrapping paper, tipping paper, tobacco paper or tobacco leaf.

It is conceivable that the second wrapper and/or the third wrapper are adhesively attached to the first wrapper and to each other at least partially. Preferably a glue is attached between the first, the second and the third wrappers. Also preferably the glue comprises cellulose, starch and/or other non-toxic suitable components.

According to another embodiment the first wrapper is a single wrapper of the aerosol generating article. The first wrapper comprising tobacco leaf portion provides preferably enough mechanical stability for carrying a whole construction of the aerosol generating article comprising the aerosol generating segment, the cooling element, the spacer element and/or the filtering mouthpiece. The first wrapper might consist wholly of the tobacco leaf. Thus, the tobacco leaf degrades faster as the usual processed paper. Due to this, the aerosol generating article might be a compostable product which comprises natural compounds. Additionally, there are benefits in the processing of the tobacco leaf wrappers compared to the common paper wrapper. These benefits contribute to sustainability and efficiency in manufacturing of the aerosol generating articles.

Preferably the non-combustible aerosol generating device for use with the aerosol generating article comprises an outside and/or inside heating system. The heating system allows an aerosol generating segment to be heated on its outside and/or inside. Preferably the aerosol generating device comprises an attachment, in particular shaped as a hollow tube, for positioning and fixing the aerosol generating article in the heating system of the aerosol generating device. The attachment may be arranged such that it extends through an entire or only a part of a length of the aerosol generating segment. This way, an optimum of a heated surface of the aerosol generating segment can be reached. The heated surface preferably provides an intensified tobacco taste during the smoking session.

The first wrapper comprising at least one tobacco leaf portion heated by the outside heating system preferably acts as an additional aerosol generating agent.

The objective is also reached by a method for manufacturing an aerosol generating article for use in a non-combustible aerosol generating device. The aerosol generating device comprises a filtering mouthpiece, an aerosol generating segment and a spacer element. Alternatively or additionally to the spacer element, the aerosol generating article comprises a support element. The spacer element is positioned between the aerosol generating segment and the filtering mouthpiece. Furthermore, the aerosol generating article extends in a length and a circumferential direction. According to the invention, the method is characterized by wrapping the aerosol generating article at least partially with a first wrapper. Additionally, the first wrapper comprises an outer and an inner surface, wherein the first wrapper comprises at least one tobacco leaf portion, wherein the tobacco leaf portion is a part of a preshaped, harvested and aged tobacco plant leaf.

Preferably the method for manufacturing comprises a paper making process for manufacturing the first wrapper comprising the tobacco leaf portion. Also preferably at least the aerosol generating segment, the spacer element and the filtering mouthpiece are preferably provided as prefabricated parts of the aerosol generating article. In one manufacturing step, the at least aerosol generating segment, the spacer element and the filtering mouthpiece may be attached to each other to form a basic construction for the aerosol generating article. Additionally, the spacer element may be attached to the aerosol generating segment and/or to the filtering mouthpiece. Additionally, a support element can be interposed between the spacer element and the aerosol generating segment.

In a manufacturing step, the elements or segments of the aerosol generating article might be wrapped by the first wrapper comprising at least one tobacco leaf portion. The first wrapper comprising at least one tobacco leaf portion might be provided and preprocessed in a separate manufacturing step. Preferably, the method for manufacturing of the first wrapper comprises a preforming step. The first wrapper may be cut into pieces or parts. Alternatively, cutouts may be punched or cut of the first wrapper. However, preferably at least one tobacco leaf portion is attached to the preformed first wrapper during a former manufacturing step. Preferably several tobacco leaf portions are adhered to a wrapper, preferably a first wrapper, or directly to the elements of the article with a suitable adhesive.

Alternatively, the aerosol generating article might be wrapped by the first wrapper comprising non-tobacco leaf (e.g. paper). In the further step, at least one tobacco leaf portion may be wounded around the aerosol generating article or at least one part of the aerosol generating article.

The tobacco leaf portion might be preshaped in a former manufacturing step.

According to another embodiment wrapping the aerosol generating segment with a second wrapper preferably comprising a paper or tobacco leaf or tobacco paper. The tobacco paper may comprise tobacco-based paper made of reconstituted tobacco. The second wrapper may be fixed by an additional manufacturing step. It is conceivable that the second wrapper is only wrapped at the aerosol generating segment, the cooling segment, the spacing segment or the filtering mouthpiece. The filtering mouthpiece may be wrapped by tipping paper in an additional step. In a further embodiment the second wrapper may be performed in a separate manufacturing step.

According to another embodiment wrapping the aerosol generating article with a third wrapper, wherein the third wrapper is adhesively attached to the first wrapper. Preferably the third wrapper comprises smaller dimensions as the second or first wrapper. Due to this, it is conceivable that the method comprises a cutting step for the second and/or the third wrapper.

BRIEF DESCRIPTION OF THE DRAWINGS

Further advantages, objectives and features of the present invention will be described, by way of example only, in the following description with reference to the appended figures. In the figures, like components in different embodiments can exhibit the same reference symbols.

The figures show.

DETAILED DESCRIPTION

Figure 1:
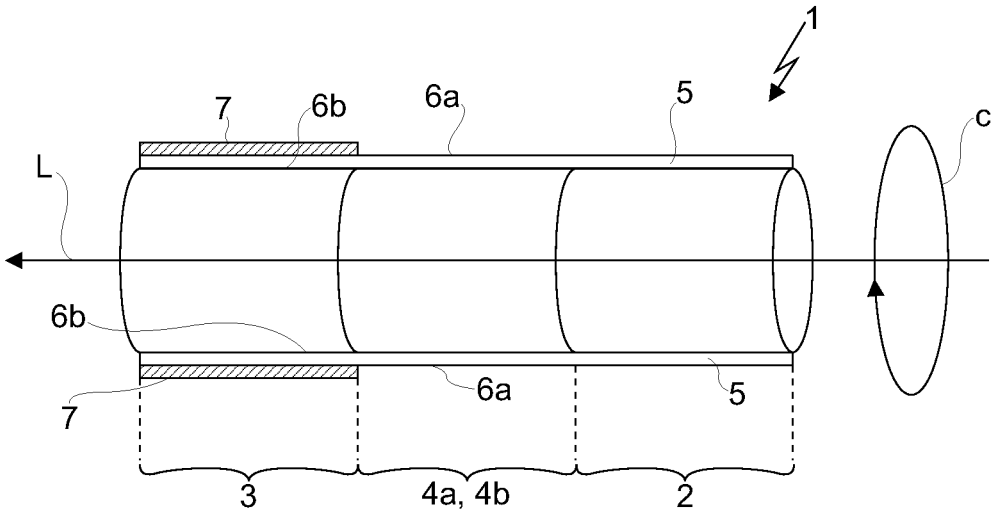
FIG. 1 schematic cross-sectional lateral view of an aerosol generating article surrounded by first wrapper comprising a tobacco leaf portion.

FIG. 1 shows a schematic cross-sectional lateral view of an aerosol generating article 1 surrounded by first wrapper 5 comprising a tobacco leaf portion 7. The tobacco leaf portion 7 is shown as a dashed area. The shown aerosol generating article 1 comprises an aerosol generating segment 3, a spacer element 4*a*, 4*b* or, alternatively combination of support element 4*a* and spacer element 4*b*, and a filtering mouthpiece 2. Furthermore, the aerosol generating article 1, in particular all segments and elements, extends along a length direction L and a circumferential direction C. The spacer element 4*a*, 4*b* may act as a cooling element of the aerosol generating article 1. In alternative embodiment, a support element 4*a* and a spacer (or cooling) element 4*b* might be provided as two separate elements (shown in FIG. 5).

The tobacco leaf portion 7 might be punched out, cut out or torn off from a tobacco plant leaf thereby being performed for the further processing. The shown tobacco leaf portion 7 is preferably provided as a single preformed strip of tobacco leaf. The tobacco leaf strip 7 might comprise a longitudinal expansion measured in an unwrapped state along the length direction L and a width expansion measured perpendicular to the length direction L. Preferably the tobacco leaf strip 7 comprises a length in range of 1 cm and 3 cm, preferably 0.5 cm and 2 cm, also preferably 2 cm and 5 cm. Furthermore, the tobacco leaf strip 7 might comprise a wide in range of 0.3 cm and 1.5 cm, preferably 0.5 and 2.5 cm, also preferably 1.5 cm and 4 cm. Moreover, the tobacco leaf strip 7 might comprise a distal and a mouth end measured along the length direction L. Preferably but not necessary the wide of the tobacco leaf strip 7 is perpendicular to its length. Alternatively, the wide of the tobacco leaf strip 7 might be at an angle to its length. In such a case the distal and/or mouth end of the tobacco leaf strip 7 might be inclined to its length. It is also conceivable that the distal and/or the mouth end of the tobacco leaf strip 7 comprises a tapered shape.

The aerosol generating article 1 is preferably surrounded by the first wrapper 5 which comprises an inner 6*b* and an outer 6*a* surface. Preferably the tobacco leaf portion 7 surrounds the aerosol generating segment 3 of the article 1. Thus, it is conceivable that a length of the tobacco leaf portion 7 corresponds to a length of the aerosol generating segment 3 measured along the length direction L.

Figure 2:
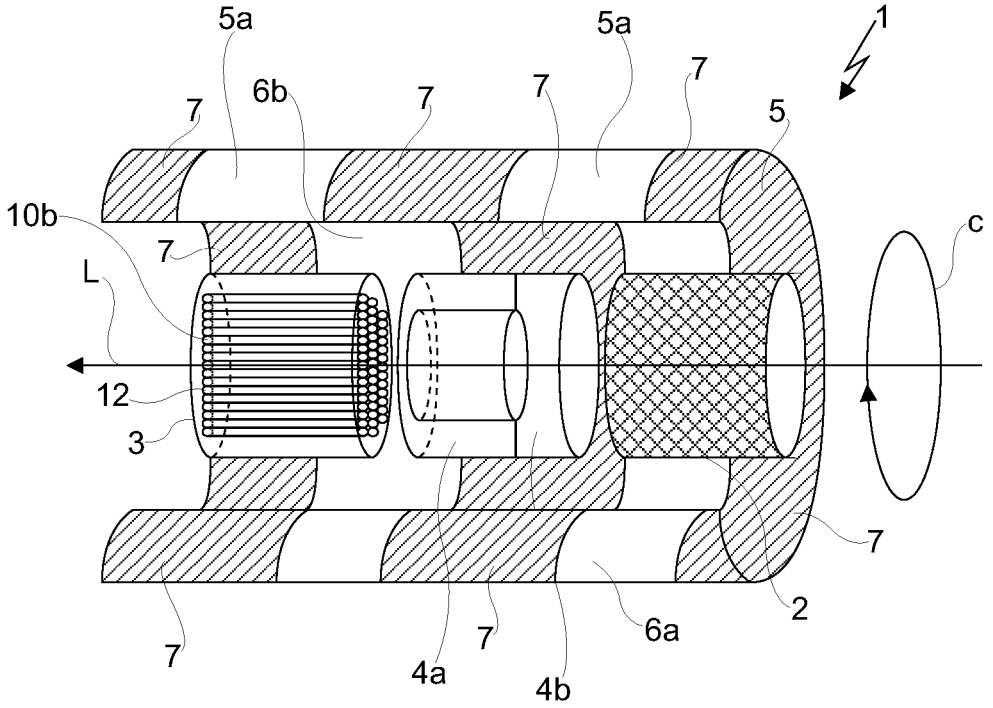
FIG. 2 schematic explosion lateral view of an aerosol generating article surrounded by a first wrapper comprising several tobacco leaf portions.

FIG. 2 shows a schematic explosion lateral view of an aerosol generating article 1 surrounded by a first wrapper 5 comprising several tobacco leaf portions 7. The shown aerosol generating article 1 corresponds to the aerosol generating article 1 shown in FIG. 1 with a difference regarding the first wrapper 5.

The shown first wrapper 5 is formed of three tobacco leaf portions 7 arranged between two portions 5*a* of the first wrapper 5. Preferably the tobacco leaf portions 7 are provided as rectangular tobacco leaf strips or pieces. It is conceivable but not necessary that the first wrapper portions 5*a* comprise similar dimensions to the tobacco leaf strips 7. Alternatively, the first wrapper portions 5*a* comprise smaller or larger dimensions compared to the dimensions of the tobacco leaf portions 7. Preferably the tobacco leaf strips 7 are adhesively attached to the first wrapper portions 5*a*. Also preferably the tobacco leaf strips 7 alternate with the first wrapper portions 5*a*. Thus, the first wrapper portions 5*a* and the tobacco leaf strips 7 are preferably preshaped for attaching to each other. However, the tobacco leaf strips 7 are preferably adhesively placed to the first wrapper portions 5*a*. Preferably the tobacco leaf strips 7 are coated at the distal and/or mouth ends with a suitable adhesive for sticking on to the first wrapper portions 5*a*. Thus, the strips 7 and the portions 5*a* result the first wrapper 5 of the aerosol generating article 1. Due to this, the first wrapper 5 comprises tobacco leaf portions 7 at its outer 6*a* and inner 6*b* surface.

The shown aerosol generating article 1 is wrapped by ring-shaped by tobacco leaf portions 7 at the aerosol generating segment 3, the element(s) 4*a*, 4*b* and the filtering mouthpiece 2. It is also conceivable that the aerosol generating article 1 is surrounded by two tobacco leaf portions 7 at the aerosol generating segment 3 and the filtering mouthpiece 2 (not shown).

The aerosol generating segment 3 of the shown aerosol generating article 1 comprises a bundle of reconstituted tobacco 12 which preferably consists of several strands. Preferably the bundle 12 comprises multiple strands of reconstituted tobacco.

The support element 4*a* preferably comprises a tubular shape with preferably a centrally located recess. Preferably the support element 4*a* abuts against to the spacer element 4*b* and wrapped by the wrapper. Alternatively a single tubular element forms the spacer element 4*a*, 4*b* and may further ensure the function of the support element. In an embodiment, the aerosol generating article 1 comprises only the spacer element 4*a* ensuring a cooling function.

The filtering mouthpiece 2 preferably comprises filter material. The filtering mouthpiece 2 may comprise a single filter segment or two or more filter segments as well as a non-filter cavity (not shown). A filter segment of the mouthpiece 2 may be a hollow tube made of filtering material. A filter segment of the mouthpiece 2 may be a filled (i.e. non-hollow) filter part. At least one or both segments comprise or are made of cellulose material, preferably cellulose acetate or paper tow. A mouth end of the filter mouthpiece may formed of a filter tube or recessed paper tube.

Figure 3A:
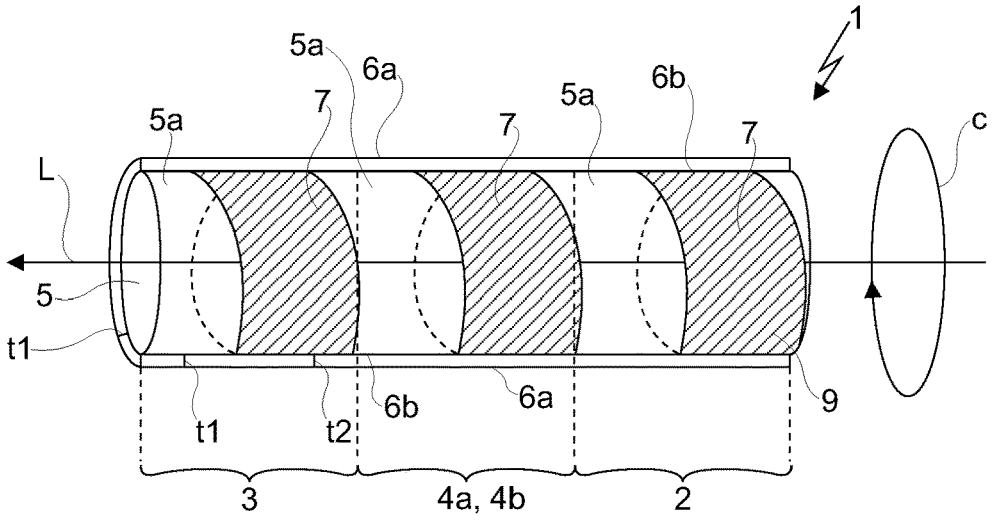
FIG. 3*a* schematic cross-sectional lateral view of an aerosol generating article surrounded by a first wrapper comprising a tobacco leaf portion at its inner surface.

FIG. 3*a* shows a schematic cross-sectional lateral view of an aerosol generating article 1 surrounded by a first wrapper 5 comprising a tobacco leaf portion 7 at its inner surface 6*b*. The outer surface 6*b* of the first wrapper 5 is not coated with tobacco leaf portion 7. Thus, the outer surface 6*b* only comprise the first wrapper 5 extending over an entire length of the aerosol generating article 1 measured along the length direction L. Preferably the tobacco leaf portion 7 is wounded around the whole aerosol generating article 1. The first wrapper portions 5*a* are positioned between each turn of the tobacco leaf portion 7 around the aerosol generating article 1.

Preferably the ribbon-like tobacco leaf portion 7 is one continuous wound strip. Also preferably, the tobacco leaf strip 7 comprises a length which corresponds to at least a double length of the aerosol generating article 1. The longitudinal expansion of the tobacco leaf strip 7 is preferably arranged at an angle to the length direction L to achieve a spiral turn around the aerosol generating article 1. Preferably, the angle comprises a range of 25° and 45°, preferably 30° and 55°, also preferably 45° and 70°. In particular, the tobacco leaf strip 7 is wrapped around the aerosol generating article 1 in such a way that it follows a spiral course which extends in the length direction L. Thus, the aerosol generating article 1 is spirally surrounded by tobacco leaf strip 7 and the tobacco leaf strip 7 carries out several spiral turns around the aerosol generating article 1.

Each turn of the tobacco leaf strip 7 are preferably spaced from each other at a distance in range of 1.3 cm and 3 cm, preferably 2.5 cm and 4.5 cm, also preferably 3 cm and 6 cm. In the shown embodiment, the turn of tobacco leaf strips 7 are at a distance to each other which corresponds to the wide of the tobacco leaf strip 7.

Preferably the mouth and the distal ends of the tobacco leaf strip 7 are fixed to the surface 6*b* of the first wrapper 5, at least at a distal or mouth end of the article 1.

In the shown figure, the tobacco leaf strip 7 spirals around the aerosol generating article 1 and thereby completes three turns. Thus, the tobacco leaf strip 7 runs circumferentially at the inner surface 6*b* of the first wrapper 5 extending at the same time in the length direction L. Preferably, each segment or element of the aerosol generating article 1 is wrapped at least once with the tobacco leaf portion 7. In particular, the aerosol generating segment 3, the spacer elements 4*b*, and optionally support element 4*a*, and the filtering mouthpiece 2 are wrapped with at least one turn of the wounded tobacco leaf portion 7.

The first wrapper 5 preferably comprises a first thickness t1 at the unwrapped portions 5*a* and another second thickness t2 at portions which comprise tobacco leaf 7. The thickness t1 is preferably in range of 0.3 mm and 2 mm. The thickness t2 is preferably in range of 0.5 mm and 2.7 mm. The difference between the first thickness t1 and the second thickness t2 is preferably invisible from the outside. Only the outer surface 6*a* of the first wrapper 5 is visible from the outside of the aerosol generating article 1. The tobacco leaf portion 7 is preferably adhesively attached to the first wrapper, in particular to the inner surface 6*b* of the first wrapper 5.

The first wrapper 5 comprising tobacco leaf portion 7 forms preferably a tube 9. The tobacco leaf portion 7 runs on the inner surface of the tube 9. The tube 9 encases the aerosol generating segment 3, the cooling 4*a* element, the spacer element 4*b* and the filtering mouthpiece 2.

Figure 3B:
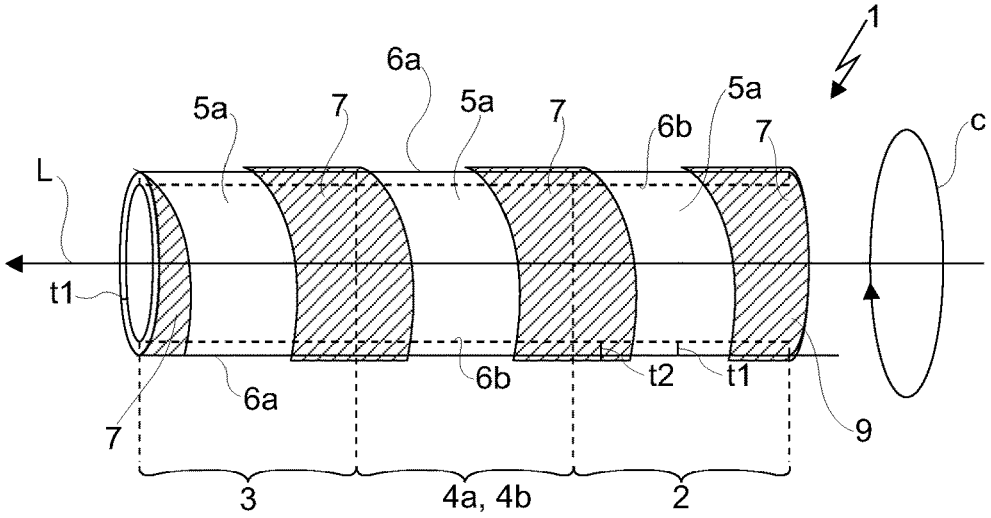
FIG. 3*b* schematic cross-sectional lateral view of an aerosol generating article surrounded by a first wrapper comprising a tobacco leaf portion at its outer surface.

FIG. 3*b* shows a schematic cross-sectional lateral view of an aerosol generating article 1 surrounded by a first wrapper 5 comprising a tobacco leaf portion 7 at its outer surface 6*a*. The shown aerosol generating article 1 is similar to the aerosol generating article 1 in FIG. 3*a*. The only difference between the two articles 2 is the applied tobacco leaf portion 7 on the inner 6*b* and outer 6*a* surfaces of the first wrapper 5. The shown first wrapper 5 preferably comprises a first thickness t1 at the unwrapped portions 5*a* and another second thickness t2 at portions which comprise tobacco leaf 7. The thickness t1 is preferably in range of 0.2 mm and 2.3 mm. The thickness t2 is preferably in range of 0.4 mm and 3 mm. The difference between the first thickness t1 and the second thickness t2 is preferably visible from the outside. The tobacco leaf portion 7 is preferably adhesively attached to the outer surface 6*a* of the first wrapper 5.

The first wrapper 5 is preferably shaped as a tube 9 which comprises at least one tobacco leaf portion 7 at its outer surface.

Figure 4:
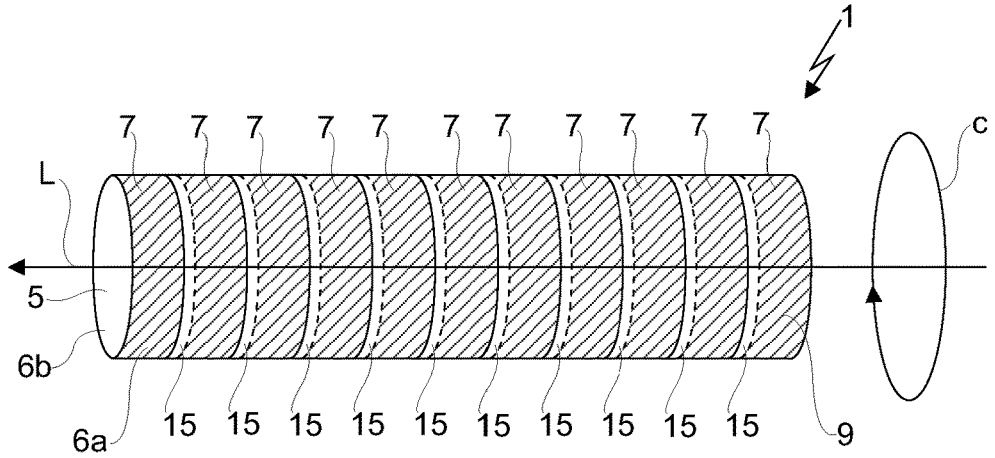
FIG. 4 schematic cross-sectional lateral view of an aerosol generating article wounded by a first wrapper being the tobacco leaf portion.

FIG. 4 shows a schematic cross-sectional lateral view of an aerosol generating article 1 wounded by a first wrapper 5 being the tobacco leaf portion 7. The tobacco leaf portion 7 is attached at the outer surface 6*a* of the first wrapper 5. The first wrapper 5 might support the wounded tobacco leaf portion 7. It is conceivable that the first wrapper is provided as a ready-made tube 9 on which the tobacco leaf portion 7 is attached. Preferably the tobacco leaf portion 7 surrounds the whole first wrapper 5 tube 9.

The wounded tobacco leaf portion 7 is preferably provided as a strip. The tobacco leaf strip 7 is wrapped around the aerosol generating article 1 in such a way that it follows a spiral course which extends in the length direction L, wherein every turn of the tobacco leaf strip 7 around the aerosol generating article 1 overlaps the previous turn thereby creating an overlap 15. The overlap 15 preferably comprises a length measured along the length direction L in a range of 1 mm and 3 mm, preferably 2.5 mm and 5 mm, also preferably 3 mm and 7 mm. The portion 7 may be adhesively sealed at the overlap 15.

It is also conceivable that the tobacco leaf portion 7 may be formed of several layers of tobacco leaf pieces with portions overlapping each other. The tobacco leaf portion 7 may comprise a natural geometry being not preformed precisely (not shown). This allows even the smallest tobacco leaf remnants of the tobacco leaf to be processed.

Figure 5:
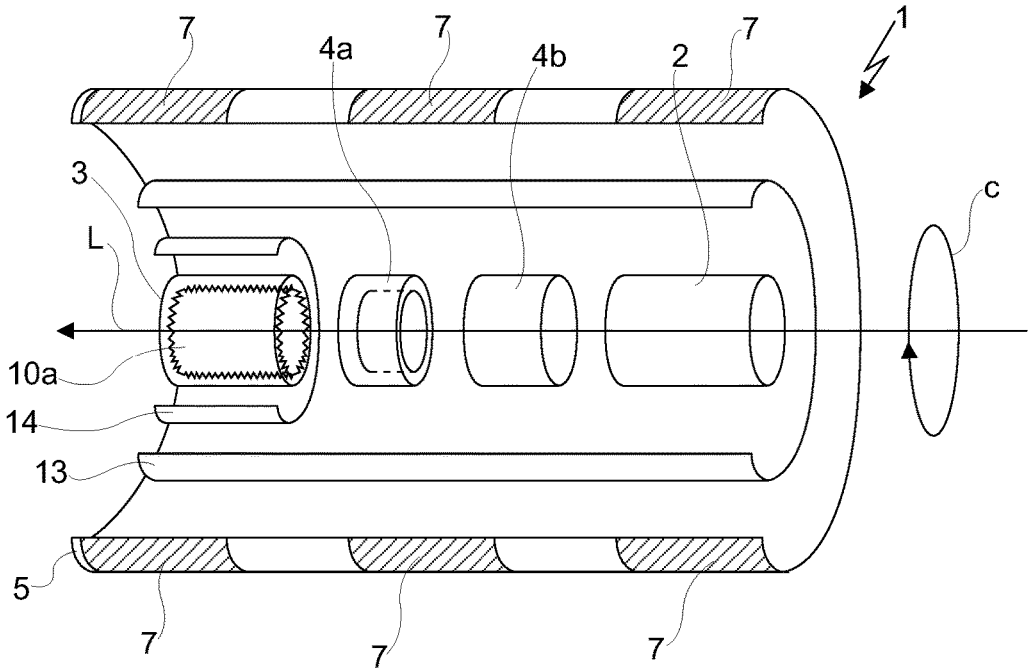
FIG. 5 schematic explosion lateral view of an aerosol generating article surrounded by a first, a second and a third wrapper.

FIG. 5 shows a schematic explosion lateral view of an aerosol generating article 1 surrounded by a first 5, a second 13 and a third 14 wrapper. The shown aerosol generating article 1 comprises a filtering mouthpiece 2, a spacer (cooling) element 4*b*, a support element 4*a* and an aerosol generating segment 3. The filtering mouthpiece 2 extends in a length direction L and is attached to the spacer element 4*b*. The spacer element 4*b* extends in the length direction L and is attached to the support element 4*a*. The support element 4*a* extends in the length direction L and is attached to the aerosol generating segment 3. The aerosol generating segment 3 extends in the length direction L and is a distal part of the aerosol generating article 1.

The aerosol generating segment 3 preferably comprises a gathered sheet 10*a* or randomly arranged shreds of reconstituted tobacco 10. The aerosol generating segment 3 is surrounded by the third wrapper 14. Preferably the third wrapper 14 comprises paper, tobacco leaf or tobacco paper.

Furthermore, the aerosol generating segment, the support element 4*a*, the spacer element 4*b* and the filtering mouthpiece 2 are surrounded by a second or combining wrapper 13. Preferably the second wrapper comprises paper or the tobacco paper.

Moreover, the whole aerosol generating article 1 is surrounded by the first wrapper 5. The first wrapper 5 comprises three tobacco leaf portions 7 attached at the outer surface 6*a* of a support layer of the first wrapper 5. The support layer can be made of paper. It is conceivable that the first wrapper 5 comprises more or less tobacco leaf portions 7 on its surfaces 6*a*, 6*b*. In particular, it is also conceivable that the first wrapper 5 comprises tobacco leaf portions 7 on its outer 6*a* and inner 6*b* surfaces.

Figure 6A:
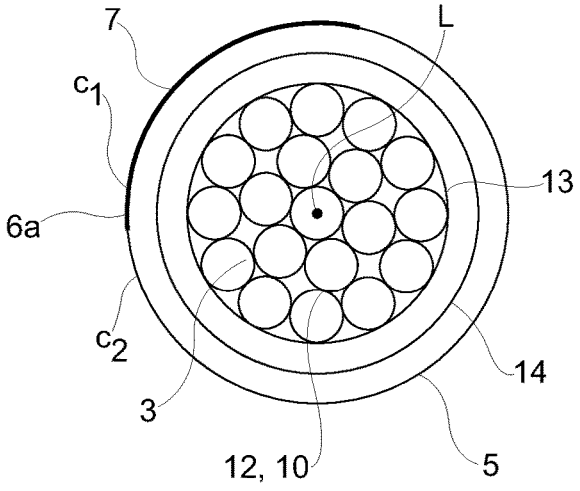
FIG. 6*a* schematic cross-sectional top view of an aerosol generating article surrounded by a first wrapper comprising a tobacco leaf portion.
Figure 6B:
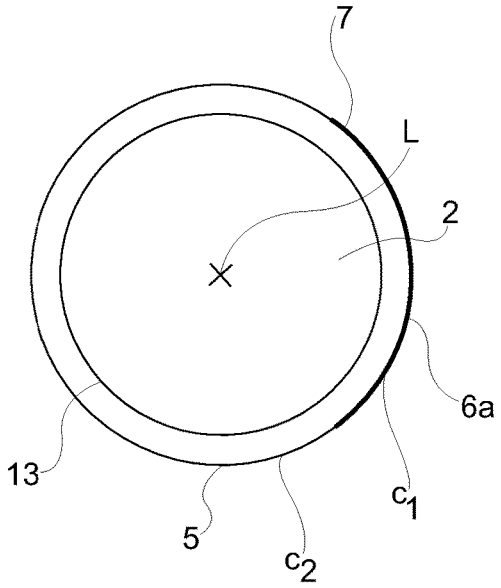
FIG. 6*b* schematic cross-sectional bottom view of an aerosol generating article surrounded by a first wrapper comprising a tobacco leaf portion.

FIGS. 6*a* and 6*b* show a schematic cross-sectional top and bottom view of an aerosol generating article 1 surrounded by a first wrapper 5 comprising a tobacco leaf portion 7. In FIG. 6*a* an aerosol generating segment 3 of the aerosol generating article 1 is shown. The aerosol generating segment 3 comprises in its center a bundle 12 of reconstituted tobacco 10. The bundle 12 is surrounded with a second wrapper 13, a third wrapper 14 and the first wrapper 5. The first wrapper 5 comprises one tobacco leaf portion 7 attached on its outer surface 6*a*. The tobacco leaf portion 7 comprises a curvature with a circumference c1 which corresponds to a circumference c2 of the first wrapper 5. The first and second wrappers 13, 14 may comprise paper material.

In FIG. 6*b* the same aerosol generating article 1 as in FIG. 6*a* is shown. However, a filtering mouthpiece 2 is arranged in the center of the aerosol generating article 1. The filtering mouthpiece 2 is surrounded by the second wrapper 13 and the first wrapper 5. The first wrapper comprises one tobacco leaf portion 7 which comprises a circumference c1 similar to the circumference c2 of the first wrapper 5.

Figure 7:
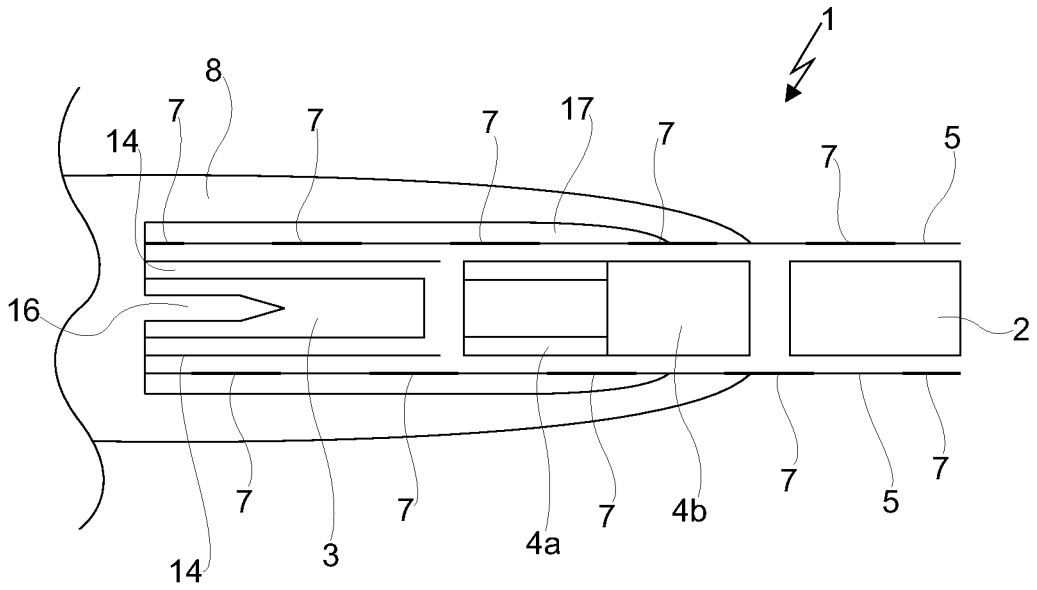
FIG. 7 schematic cross-sectional view of an aerosol generating article inserted in an aerosol generating device.

FIG. 7 shows a schematic cross-sectional view of an aerosol generating article 1 inserted in an aerosol generating device 8. The aerosol generating device 8 comprises a cavity 17 and preferably a heating element 16 inside the cavity 17. It is conceivable that the heating element 16 comprises a blade-type or pin-type heater or other inside heating system. Therefore, it is conceivable that the aerosol generating segment 3 comprises a gathered sheet, strips or strands 10*b* of reconstituted tobacco 10, as shown in FIG. 2. The aerosol generating segment 3 is inserted in the aerosol generating device 8, in particular the heating element 16 is inserted in a center of the aerosol generating segment 3.

The aerosol generating article 1 is spirally wounded with a tobacco leaf portion 7 which is preferably adhesively attached on the outer 6*a* or inner 6*b* surface of the first wrapper 5. The shown tobacco leaf portion 7 and the first wrapper 5 preferably surround the aerosol generating segment 3, a cooling element 4*a*, a spacer element 4*b* and the filtering mouthpiece 2 of the article 1.

The first wrapper 5 comprising tobacco leaf portion 7 which wraps the filtering mouthpiece 2 may absorb humectant released from the heating element 16, preferably inner heater. Preferably the tobacco leaf portion comprised in the first wrapper 5 positioned closer to the filter material inside the filtering mouthpiece 2 may act as a filter for humectant.

The applicant reserves his right to claim all features disclosed in the application document as being an essential feature of the invention, as long as they are new, individually or in combination, in view of the prior art. Furthermore, it is noted that in the figures features are described, which can be advantageous individually. Someone skilled in the art will directly recognize that a specific feature being disclosed in a figure can be advantageous also without the adoption of further features from this figure. Furthermore, someone skilled in the art will recognize that advantages can evolve from a combination of diverse features being disclosed in one or various figures.

LIST OF REFERENCE SYMBOLS

1 aerosol generating article
2 filtering mouthpiece
3 aerosol generating segment
4*a* support element
4*b* spacer element
5 first wrapper
5*a* first wrapper portion
6*a* outer surface of the first wrapper
6*b* inner surface of the first wrapper
7 tobacco leaf portion
8 aerosol generating device
9 tube
10 reconstituted tobacco
10*a* gathered sheet of reconstituted tobacco
10*b* strips or strands of reconstituted tobacco
11 rod
12 bundle of reconstituted tobacco
13 second wrapper
14 third wrapper
15 overlap
16 heating element
17 cavity in the aerosol generating device
c1 circumference of the tobacco leaf portion c2 circumference of the first wrapper
l1 length of the tobacco leaf portion l2 length of the aerosol generating article
t1 first thickness of the first wrapper
t2 second thickness of the first wrapper
L length direction
C circumferential direction

The invention claimed is:

1. An aerosol generating article for use in a non-combustible aerosol generating device comprising a filtering mouthpiece, an aerosol generating segment and a spacer element positioned between the aerosol generating segment and the filtering mouthpiece, and being wrapped at least partially by a first wrapper, wherein the first wrapper comprises an outer surface and an inner surface, wherein the aerosol generating article extends in a length direction and a circumferential direction, wherein the first wrapper comprises at least one tobacco leaf portion, wherein the at least one tobacco leaf portion is a part of a preshaped, harvested and aged tobacco plant leaf.

2. The aerosol generating article according to claim 1, wherein the at least one tobacco leaf portion extends along the length direction and comprises a length which corresponds to a length of the aerosol generating article.

3. The aerosol generating article according to claim 1, wherein the at least one tobacco leaf portion extends along the circumferential direction and comprises a circumference which corresponds to a circumference of the aerosol generating article.

4. The aerosol generating article according to claim 1, wherein the at least one tobacco leaf portion is arranged as the outer surface and/or the inner surface of at least the first wrapper.

5. The aerosol generating article according to claim 1, wherein the at least one tobacco leaf portion is formed as a spirally wound tube as the outer surface and/or the inner surface of the first wrapper.

6. The aerosol generating article according to claim 1, wherein the aerosol generating segment is formed as a rod comprising reconstituted tobacco.

7. The aerosol generating article according to claim 6, wherein the reconstituted tobacco is at least one gathered sheet.

8. The aerosol generating article according to claim 6, wherein the reconstituted tobacco is formed as a plurality of reconstituted tobacco strips or strands extending along the length direction.

9. The aerosol generating article according to claim 6, wherein the reconstituted tobacco is formed as a reconstituted tobacco cut filler which is randomly oriented in the aerosol generating segment.

10. The aerosol generating article according to claim 1, wherein the aerosol generating segment is individually wrapped with a second wrapper comprising at least one of: paper, cellulose acetate, aluminium foil, tobacco leaf, or tobacco paper.

11. The aerosol generating article according to claim 10, wherein the aerosol generating article comprises a third wrapper which is adhesively attached to the first wrapper at least partially.

12. The aerosol generating article according to claim 1, wherein the first wrapper is a single wrapper of the aerosol generating article.

13. The aerosol generating article according to claim 1, wherein the first wrapper comprises two layers, wherein the at least one tobacco leaf portion is a layer of the two layers of the first wrapper adhesively attached on the outer surface or the inner surface of a second layer of the two layers of the first wrapper.

14. The aerosol generating article according to claim 13, wherein the layers of the first wrapper are superimposed or at least overlapping.

15. The aerosol generating article according to claim 1, wherein several tobacco leaf portions of the at least one tobacco leaf portion are distributed on the entire outer surface and/or the entire inner surface of the first wrapper.

16. The aerosol generating article according to claim 15, wherein the several tobacco leaf portions are attached to the inner surface and/or the outer surface of the first wrapper as rings, wherein the tobacco leaf rings enclose the aerosol generating article circumferentially.

17. The aerosol generating article according to claim 16, wherein the ring of one of the several tobacco leaf portions replaces at least one lacking portion of the first wrapper.

18. The aerosol generating article according to claim 1, wherein the at least one tobacco leaf portion comprises at least one adhesive surface glued to portions or edges of the first wrapper thereby replacing lacking portions with the at least one tobacco leaf portion.

19. A method for manufacturing an aerosol generating article for use in a non-combustible aerosol generating device, wherein the aerosol generating device comprises a filtering mouthpiece, an aerosol generating segment and a spacer element positioned between the aerosol generating segment and the filtering mouthpiece, wherein the aerosol generating article extends in a length direction and a circumferential direction, the method comprising:

wrapping the aerosol generating article at least partially with a first wrapper, wherein the first wrapper comprises an outer surface and an inner surface, wherein the first wrapper comprises at least one tobacco leaf portion, wherein the at least one tobacco leaf portion is a part of a preshaped, harvested and aged tobacco plant leaf.

20. The method according to claim 19, further comprising:

wrapping the aerosol generating segment with a second wrapper comprising a paper or tobacco leaf or tobacco paper.

21. The method according to claim 20, further comprising wrapping the aerosol generating article with a third wrapper, wherein the third wrapper is adhesively attached to the first wrapper.

* * * * *